United States Patent [19]

Agcaoili

[11] 4,119,338

[45] Oct. 10, 1978

[54] CARPET KICKER HAVING MEANS FOR ADJUSTING SHANK LENGTH

[75] Inventor: Clarito R. Agcaoili, Glendale Heights, Ill.

[73] Assignee: United States Gypsum Company, Chicago, Ill.

[21] Appl. No.: 714,052

[22] Filed: Aug. 13, 1976

[51] Int. Cl.[2] ..... A47G 27/04

[52] U.S. Cl. ..... 294/8.6

[58] Field of Search ..... 294/8.6, 19 R, 93, 94, 294/96; 254/57, 58, 59, 60, 61, 62, 63; 403/104, 374; 16/5

[56] References Cited

U.S. PATENT DOCUMENTS

| | | | |
|---|---|---|---|
| 3,374,023 | 3/1968 | Hill et al. | 294/8.6 |
| 3,953,138 | 4/1976 | Hine et al. | 403/104 |

*Primary Examiner*—James B. Marbert

*Attorney, Agent, or Firm*—Samuel Kurlandsky; Robert H. Robinson; Kenneth E. Roberts

[57] ABSTRACT

A carpet stretcher or kicker operable by engagement with the knee of an operator, the carpet stretcher or handle having a shank, a head with carpet-engaging pins adjustably mounted therein positioned at one end of the shank, and a kicking plate having a padded cover at the other end, the shank being formed of telescoping shank members which may be rotated ninety degrees with respect to each other for disengagement, moved longitudinally with respect to each other to obtain the desired shank length, and then rotated ninety degress with respect to the original relative position to lock the members axially with respect to each other.

3 Claims, 25 Drawing Figures

CARPET KICKER HAVING MEANS FOR ADJUSTING SHANK LENGTH

BACKGROUND OF THE INVENTION

1. Field of Invention

The present invention relates to a device for stretching carpet, and more particularly refers to a device having adjustable carpet-engageable teeth or pins at one end and a padded plate engageable by the knee of an operator at the other, whereby the operator may move the edge of the carpet for stretching by applying his knee against the padded plate and pushing or kicking.

2. Description of the Prior Art

Carpet stretchers or kickers having a carpet-gripping head with teeth or prongs engageable with the carpet on which it is placed are well known in the art. Such devices include a shank having the head with carpet-engaging teeth at one end and a knee-engageable plate or bumper at the other. A force applied to the padded plate is transmitted through the shank and stretches the carpeting which is gripped by the teeth of the head. The length of the shank should be adjustable to permit the operator to work under various conditions. Additionally, the size of the shank should be adjustable for various size operators. Various means have been employed for adjusting the length of the carpet kicker shank. In U.S. Pat. No. 3,359,032 telescoping shank members are provided which are locked together in an adjusted position by means of a collet having a plurality of fingers and tightened by means of a threaded sleeve.

In U.S. Pat. No. 3,374,023 the relative position of telescoping shank members is engaged or released by means of a trigger arangement engaging transverse detents. Various other means of providing an adjustable shank have been utilized, but all have been found to be deficient in certain respects, as for example ease of use, high cost of materials or fabrication, or lack of positive engagement.

SUMMARY OF THE INVENTION

It is accordingly an object of the present invention to provide a carpet kicker having an adjustable shank formed of telescoping shank members wherein the shank members are locked and unlocked into various relative longitudinal positions by rotative movement of the shank members.

It is another object of the invention to provide a device as described in which, when the shaft members are locked together, there is no longitudinal or axial freedom of movement between the shank members so that when the operator applies force to the kicker, no clicking from relative freedom of movement results.

It is still further an object to provide a carpet kicker which is relatively simple to fabricate, and which is reliable over extended periods of use.

It is a further object to provide a carpet kicker wherein the length of the shank may be quickly and easily adjusted to any of a plurality of predetermined positions.

Other objects and advantages of the invention will become apparent upon reference to the drawings and detail of the description.

According to the invention a carpet kicker is provided having a shank, a head mounted at one end of the shank, and a plurality of adjustably mounted pins provided therein. A kicker plate is mounted at the other end of the shank and has a padded covering thereover to prevent injury to the knee of the operator. The shank is formed of a pair of telescoping shank members, the inner one having spring-mounted ball bearings positioned in cam members. The other member has grooves defining detents which are engaged by the cam members in one rotative position and which are released when the shank members are turned through an angle of ninety degrees with respect to each other for adjusting the length of the shank. The cam members and detent members are subsequently engaged in the new axial position when the shank members are once again rotated 90° with respect to each other. Detents are provided to receive the ball bearings and to retain the two members in rotative position with respect to each other at positions 90° apart.

DESCRIPTION OF THE PREFERRED EMBODIMENTS

Figure 1:
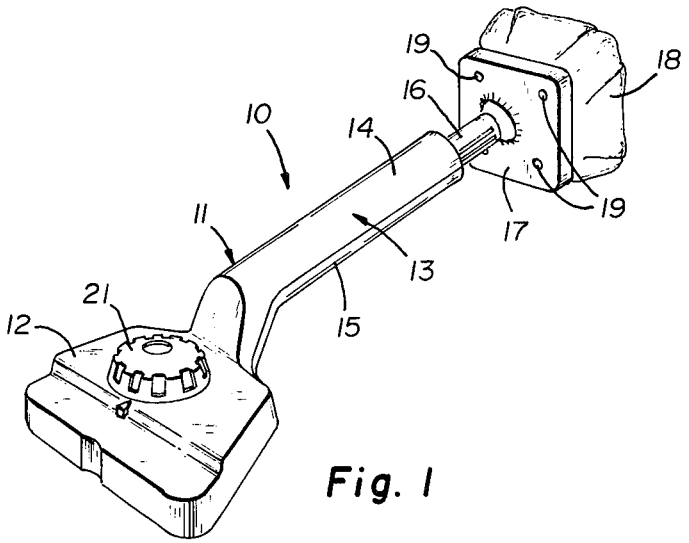
FIG. 1 is a perspective view of the carpet kicker of the invention.
Figure 2:
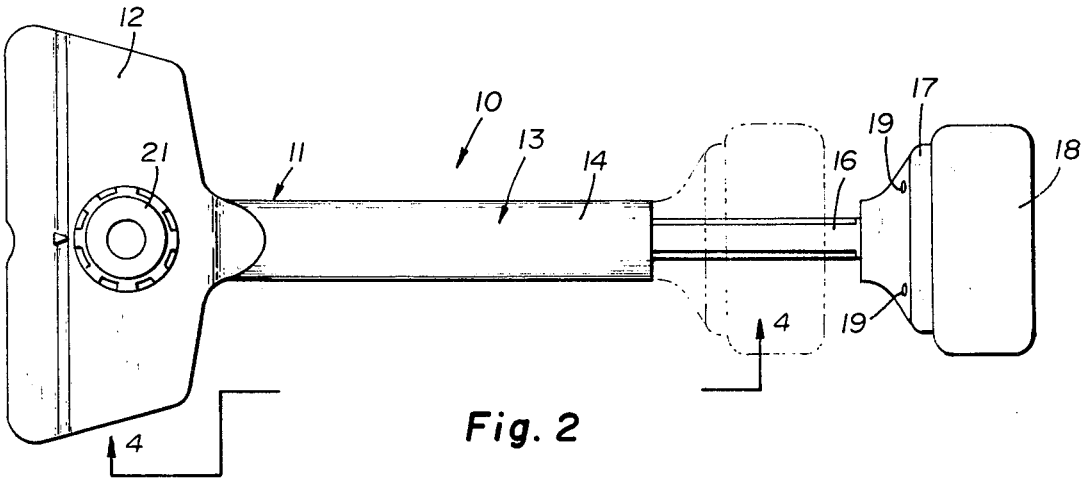
FIG. 2 is a top view of the carpet kicker shown in FIG. 1, showing the extended position of the shank in the solid lines and the retracted position of the shank in the broken lines.
Figure 3:
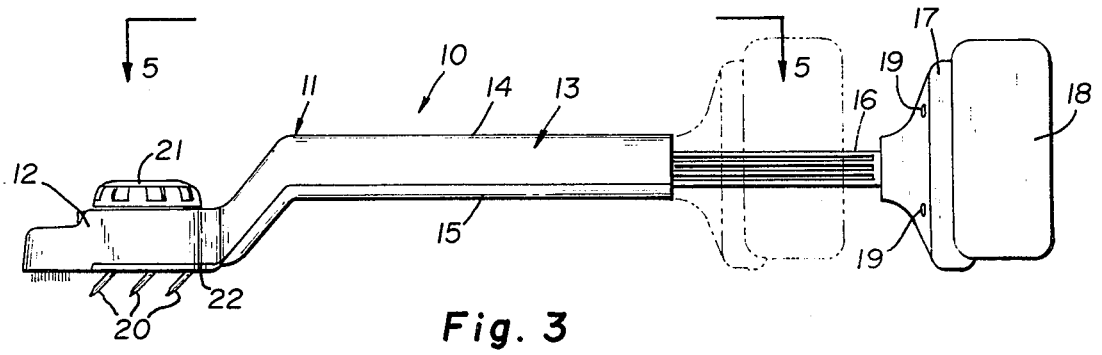
FIG. 3 is a side elevational view of the carpet kicker shown in FIG. 2.

Referring to FIGS. 1–3, a carpet kicker 10 is shown comprising a housing 11 having a head 12 and a handle or shank 13. The housing is formed of an integral upper housing member 14 and an integral lower housing member 15. A telescoping inner shank member 16 is adjustably mounted within the handle 13 and has a kicker plate 17 affixed to the end thereof with a knee pad 18 affixed to the kicker plate 17 by means of screws 19. Within the head 12 is a an assembly mounting a plurality of pins 20, the extension of the pins 20 being controlled by a knob 21. The structure of the assembly is not shown in detail but is disclosed and claimed in U.S. Pat. No. 3,359,032, of the present applicant. The overall length of the handle 13 and the telescoping inner shank member 16 may be adjusted by rotating the kicker plate 17 and knee pad ninety degrees, thereby freeing the telescoping shank member to move axially to any of a group of predetermined positions. A further rotation of ninety degrees back to the normal rest position re-engages the handle 13 with the shank member 16. One of the adjustable positions is indicated in FIGS. 2 and 3 by a broken line. A guard plate 22 is mounted on the bottom of the head 12 to protect the inner mechanism and to prevent accidental engagement with the pins 20 when the pin supporting mechanism is withdrawn within the head.

Referring to FIGS. 9–13, the upper housing member 14 is shown in detail and is formed preferrably by die casting of a suitable metal such as aluminum. The upper housing member 14 is provided with cam grooves 26 and 27 defining cam detents 28 and 29 in the form of protuberances. The cam detents 28 and 29 have straight detent surfaces 30 and 31 on one side substantially perpendicular to the walls of the upper housing member 14. On the other side of each cam detent are beveled detent surfaces 32 and 33. Starting at each cam groove are ball bearing guide members 34 which cooperate with the upper surface 35 of the upper member 14 to form a half cylindrical surface for guiding the ball bearings of the cams, to be described. Detents 37 in the form of partial spherical depressions are provided for receiving the ball bearings of the cams and retaining the cams in position during adjustment. Detent recess members 38 are provided at the ends of the ball bearing guide members. Threaded apertures 39 are provided in the handle portion and threaded apertures 40 are provided in the head portion for engaging screws positioned through apertures in the lower housing member. A stop 41 is provided at the end of the housing.

Referring to FIGS. 14–20, the lower housing member 15 is shown and comprises a plurality of ball bearing guide members 47, each having detents 49 at the bottom thereof in the form of a partial spherical depression. At the end of ball bearing guide members 47 are detent recess members 50. Plate screw apertures 52 and terminal screw notches 53 are provided for affixing the lower housing member 15 to the upper housing member 14 by means of screws. Tabs 54 are provided for registry with notches 42 provided in the upper housing member 14. A stop member 56 is provided for cooperating with the stop member 41 for restraining rearward movement of the telescoping inner shank 16. Ridges 57 and 58 provide increased strength and rigidity for the portion of the handle which connects to the head 12.

Figure 5:
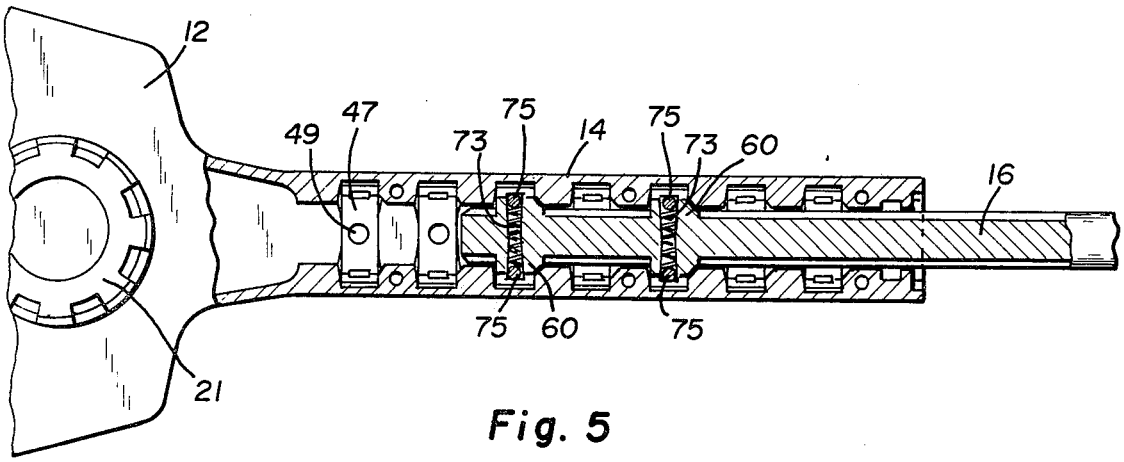
FIG. 5 is a longitudinal sectional view taken at the line 5 — 5 of FIG. 3, looking in the direction of the arrows.
Figure 6:
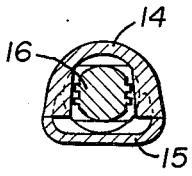
FIG. 6 is a cross-sectional view taken at the line 6 — 6 of FIG. 4, looking in the direction of the arrows.
Figure 7:
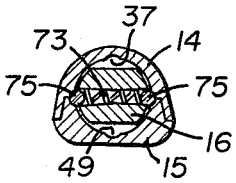
FIG. 7 is a cross-sectional view taken at the line 7 — 7 of FIG. 4, looking in the direction of the arrows.

Referring to FIGS. 21–25, the telescoping inner shank 16 is shown having cam members 60 which have cylindrical end surfaces 62 and flat side surfaces 64. The operative portion of the cams have straight cam surfaces 66 and beveled cam surfaces 68. Transverse bores 70 are provided in the cam members arranged to have helical springs 73 disposed in the bores 70 with ball bearings 75 mounted at each end of the springs. (FIGS. 5, 7 and 8).

Referring to FIGS. 4–8, the carpet kicker of the present invention is shown in assembled form. As shown, the ball bearing guide members 34, the upper surface 35 of the upper housing member, the ball bearing guide members 47 and the bottom of the lower housing member cooperate to form a cylindrical surface on which the ball bearings 75 may roll over a complete circle of 360°. The spherical depression detents 37 and the spherical depression detents 49 engage the ball bearings 75 when the cam members 60 are disengaged from the cam detents 28 and 29. The detent recess members 38 and the detent recess members 50 cooperate to define detents which retain the ball bearings in fixed rotative position when the cam members 60 are engaged in the cam grooves 26 and 27 intermediate the cam detents 28 and 29 and are maintained in fixed operating position. This position is shown in FIGS. 4–7.

Figure 4:
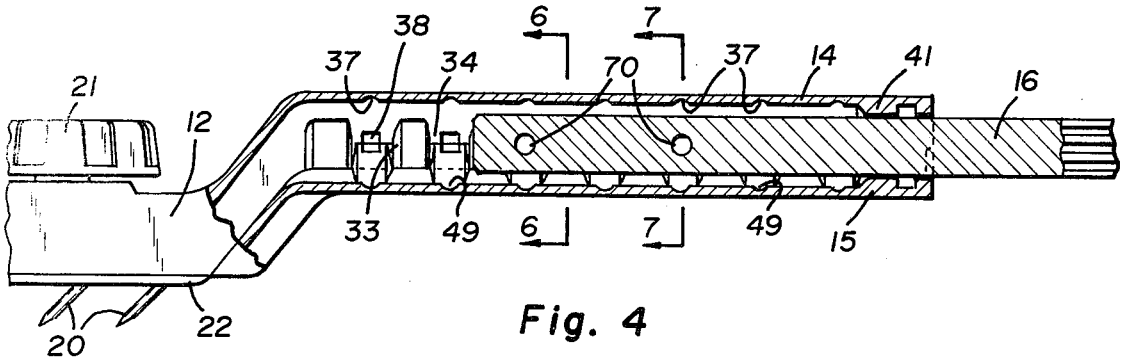
FIG. 4 is a longitudinal vertical section taken at the lines 4 — 4 of FIG. 2, looking in the direction of the arrows.
Figure 8:
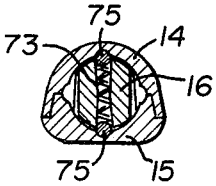
FIG. 8 is a cross-sectional view taken at the same position as FIG. 7, but with the inner shank member rotated through an angle of 90° with respect to the outer shank member.
Figure 9:
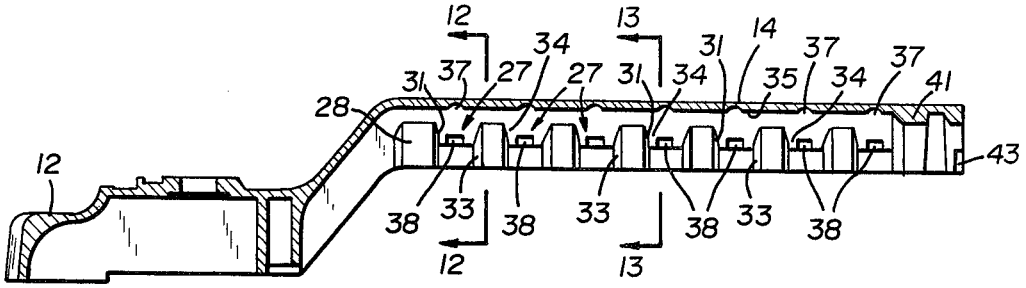
FIG. 9 is a cross-sectional view of the upper housing comprising the head and the upper shank member, taken at the line 9 — 9 shown in FIG. 10, looking in the direction of the arrows.
Figure 10:
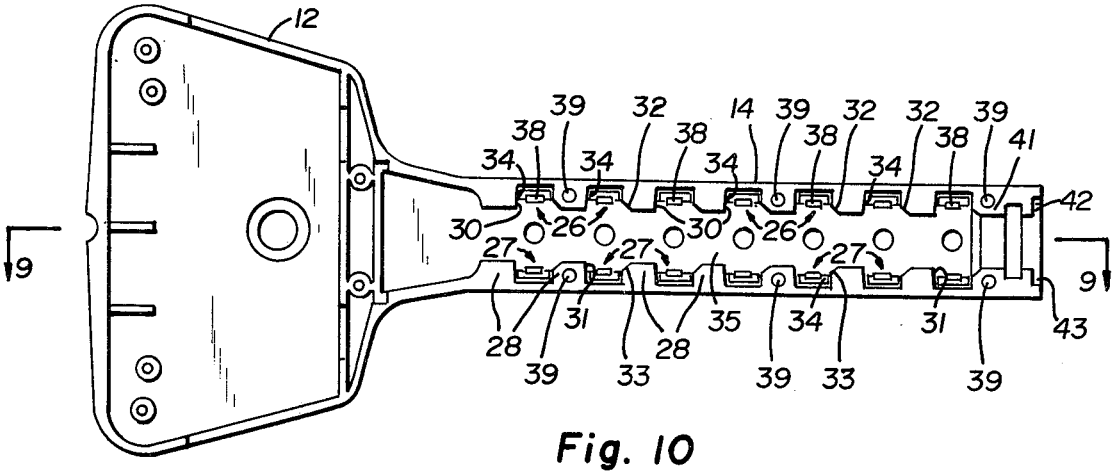
Figure 11:
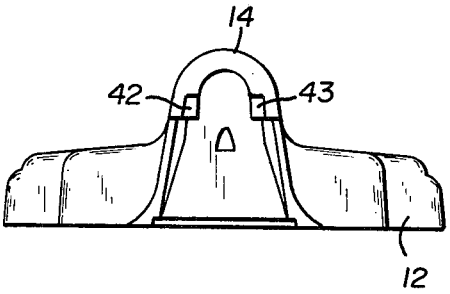
FIG. 11 is a rear view of the structure shown in FIG. 9.
Figure 12:
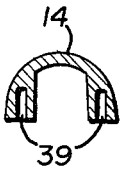
FIG. 12 is a cross-sectional view of the housing shown in FIG. 9 taken at the line 12 — 12 of FIG. 9.
Figure 13:
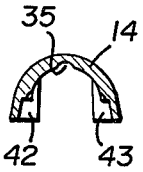
FIG. 13 is a cross-sectional view at the line 13 — 13 of FIG. 9, looking in the direction of the arrows.
Figure 14:
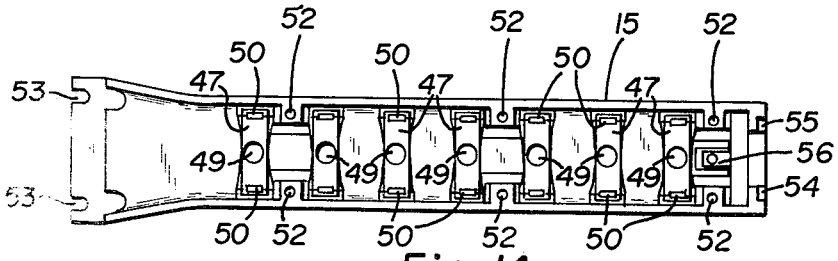
FIG. 14 is a top plan view of the lower housing member.
Figure 17:
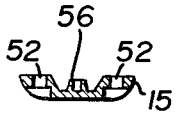
FIG. 17 is a cross-sectional view taken at the line 17 — 17 of FIG. 15, looking in the direction of the arrows.
Figure 15:
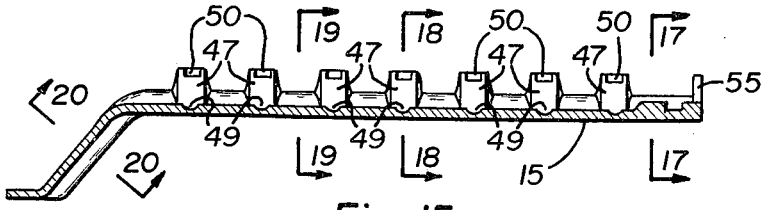
FIG. 15 is a side elevational view of the lower housing member shown in FIG. 14.
Figure 18:
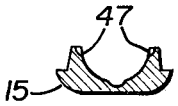
FIG. 18 is a cross-sectional view taken at the line 18 — 18 of FIG. 15, looking in the direction of the arrows.
Figure 19:
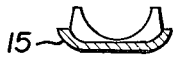
FIG. 19 is a cross-sectional view taken at the line 19 — 19 of FIG. 15, looking in the direction of the arrows.
Figure 16:
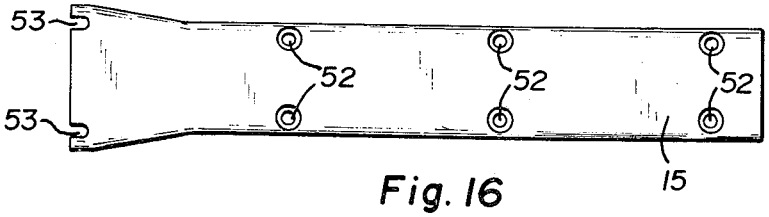
FIG. 16 is a bottom plan view of the lower housing member shown in FIGS. 14 and 15.
Figure 20:
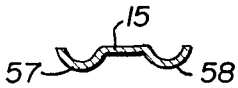
FIG. 20 is a cross-sectional view taken at the line 20 — 20 of FIG. 15, looking in the direction of the arrows.
Figure 21:
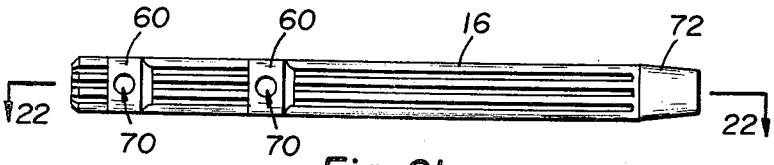
FIG. 21 is a top view of the telescoping inner shank.
Figure 24:
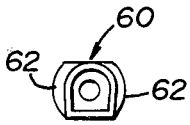
FIG. 24 is an end view of the telescoping inner shank shown in FIG. 21.
Figure 22:
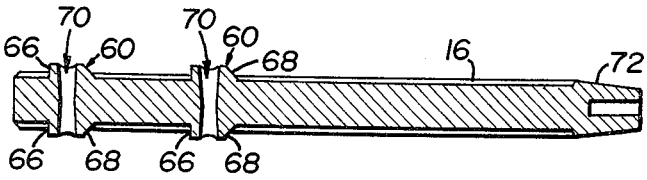
FIG. 22 is a sectional view taken at the line 22 — 22 of FIG. 21, looking in the direction of the arrows.
Figure 25:
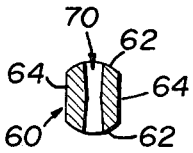
FIG. 25 is a cross-sectional view taken at the line 25 — 25 of FIG. 23, looking in the direction of the arrows.
Figure 23:
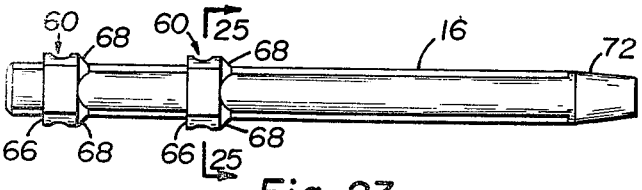
FIG. 23 is a side elevational view of the telescoping inner shank shown in FIGS. 21 and 22.

In FIG. 8 a cross-sectional view is shown in which the telescoping inner shank 16 has been rotated through an angle of 90° until the ball bearings are engaged in the spherical depression detents 37 and 49. In this position the inner shank 16 may be pushed inwardly or pulled outwardly axially until the ball bearings encounter another pair of spherical surface detents and are indexed thereby. The knee pad and kicker plate may then be grasped and rotated 90° to the original rotative position in which the cam members are engaged in the cam grooves and the ball bearings are engaged in the recesses formed by the detent members in a new position, as shown in FIGS. 4, 5 and 7.

The carpet kicker apparatus of the present invention has a number of advantages over similar devices of the prior art. First, the parts may be formed by die casting a metal such as aluminum and expensive machining is avoided. Second, the device is very easy to use. In order to adjust the length of the handle, it is only necessary to rotate the kicker plate and pad 90° to a position defined by the engagement of the spring-loaded ball bearings with the detent depressions provided in both the upper wall and lower wall of the handle. The telescoping portion of the shank may then be moved axially inwardly or outwardly until a detent position is reached at the desired length. The kicker plate and pad are then rotated 90° to the original rest position, at which point the ball bearings engage the detents provided at the sides and the cam members become positively engaged in the cam grooves. In this new position the cam surfaces are positively engaged, and when the operator strikes the kicker pad, there will be no clicks caused by excessive play between the cam surfaces. The presence of complementary beveled cam surfaces on both the cam members and the cam detents facilitate engagement of the rotating cams with the cam surfaces of the cam detents. The apparatus is extremely rugged and will withstand use over extended periods of time when utilized in the carpet laying art.

It is to be understood that the invention is not to be limited to the exact details of operation or materials shown or described, as obvious modifications and equivalents will be apparent to one skilled in the art.

Invention is claimed as follows:

1. A carpet kicker for stretching carpet having a pile and a backing, comprising:

(A) A housing formed of an upper housing member and a lower housing member affixed together by fastening means comprising:

(1) A head member having a plurality of pins adjustably mounted for engaging said carpet, (2) A handle member having a plurality of detent members internally positioned therein in fixed relationship to said handle member and spaced apart by detent grooves, and having a plurality of groups of detent depressions, the depressions of each group being in coplanar arrangement and spaced apart 90° circumferentially, each group being spaced axially from adjacent groups, and (B) An inner shank member arranged to telescope within said handle member and having a padded member mounted at the end thereof for being engaged by the knee of an operator, said inner shank member having at least one cam member in fixed relationship thereto, said cam member being provided with a transverse bore having a helical compression spring mounted therein with a ball bearing at the end of said spring adapted to engage said detent depressions, wherein the handle member portion of said upper housing member and the handle member portion of said lower housing member are each provided with spaced-apart ball bearing guide members each defining a segment of an inner cylindrical surface, the ball bearing guide members of said upper housing member cooperating with the ball bearing guide members of said lower housing member to define inner cylindrical surfaces on which the ball bearing of said cam member travels, and each cylindrical surface having four of said detent depressions for engaging said ball bearings either in the locked operative position or in the unlocked adjustment position, and providing indexing during axial adjustment movement to indicate the positions in which said inner shank member may be rotated to place it in the locked position, said inner shank member being adapted to be placed in at least one rotative position wherein said cam member is disposed within one of said detent grooves and engages the detent surfaces of said detent members to restrain said inner shank member axially, and being adapted to be rotated to another rotative position in which said cam member is free of said detent members and said inner shank member is free to be moved axially to another position with respect to said handle member indexed by said detent depressions, and wherein said inner shank member is adapted to be rotated again to the original rotative position in which said cam member once again engages said detent members and said inner shank member is once again fixed axially with respect to said handle member at a different relative axial position.

2. A carpet kicker according to claim 1, wherein said cam member is provided with a transverse bore having a helical compression spring mounted therein with a ball bearing at each end of said spring adapted to engage said detent depressions.

3. A carpet kicker according to claim 1, having a pair of cam members, said cam members being elongated transversely with respect to said inner shank member.

* * * * *